US010294002B2

(12) United States Patent
Berger et al.

(10) Patent No.: US 10,294,002 B2
(45) Date of Patent: May 21, 2019

(54) EASY OPEN PACKAGE

(71) Applicant: Kimberly-Clark Worldwide, Inc., Neenah, WI (US)

(72) Inventors: Maggie VanderHeiden Berger, Appleton, WI (US); Linda Jo Van Dyke, Neenah, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 90 days.

(21) Appl. No.: 15/542,590

(22) PCT Filed: Jan. 28, 2015

(86) PCT No.: PCT/US2015/013244
§ 371 (c)(1),
(2) Date: Jul. 10, 2017

(87) PCT Pub. No.: WO2016/122479
PCT Pub. Date: Aug. 4, 2016

(65) Prior Publication Data

US 2017/0369222 A1 Dec. 28, 2017

(51) Int. Cl.

| | |
|---|---|
| ***B65D 77/32*** | (2006.01) |
| ***B65D 75/58*** | (2006.01) |
| ***G09F 3/10*** | (2006.01) |
| ***B65D 75/66*** | (2006.01) |
| ***B65D 75/02*** | (2006.01) |
| ***B65D 77/00*** | (2006.01) |

(52) U.S. Cl.
CPC ..... *B65D 77/32* (2013.01); *B65D 75/02* (2013.01); *B65D 75/5838* (2013.01); *B65D 75/5894* (2013.01); *B65D 75/66* (2013.01); *B65D 77/003* (2013.01); *G09F 3/10* (2013.01); *B65D 2203/02* (2013.01)

(58) Field of Classification Search
CPC ..... B65D 75/66; B65D 75/54; B65D 75/02; B65D 75/5835; B65D 75/5894; B65D 2203/02; B65D 77/003; B65D 77/32; B65D 63/1009; G09F 3/10
See application file for complete search history.

(56) References Cited

U.S. PATENT DOCUMENTS

| | | | |
|---|---|---|---|
| 2,777,601 | A | 1/1957 | Cheeley |
| 3,301,395 | A | 1/1967 | Swezey |

(Continued)

FOREIGN PATENT DOCUMENTS

| | | | |
|---|---|---|---|
| CN | 88100984 | A | 7/1988 |
| CN | 1781819 | A | 6/2006 |

(Continued)

*Primary Examiner* — Mollie Impink
(74) *Attorney, Agent, or Firm* — Kimberly-Clark Worldwide, Inc.

(57) ABSTRACT

The present invention provides a package wrapping that utilizes a film having a pair of spaced apart perforations defining a perforation zone there between, a carton label having a pair of spaced apart tabs defining a notch that extends across and makes visible a portion of the perforation zone when the label overlays the film, and an adhesive extending across a portion of the perforation zone and one of the spaced apart tabs wherein the carton label is not adhered to the film.

20 Claims, 5 Drawing Sheets

(56) References Cited

U.S. PATENT DOCUMENTS

| | | | | |
|---|---|---|---|---|
| 3,314,210 | A | 4/1967 | Jarund | |
| 3,344,975 | A | 10/1967 | Stoker, Jr. | |
| 3,498,448 | A | 3/1970 | Kuster | |
| 3,747,749 | A | 7/1973 | Brown | |
| 4,981,213 | A | 1/1991 | Dillon | |
| 5,129,518 | A | 7/1992 | Tanaka et al. | |
| 5,866,181 | A | 2/1999 | Hill | |
| 6,041,930 | A | 3/2000 | Cockburn | |
| 6,044,975 | A * | 4/2000 | Dirx | B41J 13/00 206/451 |
| 7,216,764 | B2 | 5/2007 | Forman | |
| 2003/0118255 | A1 | 6/2003 | Miller | |
| 2009/0238502 | A1 | 9/2009 | Bhattacharjee et al. | |
| 2013/0114918 | A1 | 5/2013 | Lyzenga et al. | |

FOREIGN PATENT DOCUMENTS

| | | | |
|---|---|---|---|
| CN | 201261597 | Y | 6/2009 |
| CN | 101559859 | A | 10/2009 |
| DE | 8023682 | U1 | 12/1981 |
| EP | 0601931 | A1 | 6/1994 |
| JP | 06-100025 | A | 4/1994 |
| JP | 11-292141 | A | 10/1999 |
| JP | 2002-205771 | A | 7/2002 |
| JP | 2009-007054 | A | 1/2009 |
| WO | WO 1999/026849 | A1 | 6/1999 |
| WO | WO14164424 | A1 | 10/2014 |

* cited by examiner

EASY OPEN PACKAGE

BACKGROUND OF THE DISCLOSURE

Packaged articles are often provided with a thin film wrapper to protect the packaged article or to preserve its contents. Various systems have been devised to remove the film wrapper without resorting to tools and the like, such as providing a tear tape or tab. Such tape and tabs help the consumer to open the wrapper by pulling on the tab or tape causing the film to rupture and facilitate removal. Examples of packaged articles provided with such tapes and tabs include packaged consumer goods, packaged media such as compact discs and digital video discs, as well as various packaged food and beverages.

While tabs and tape may be suitable for removing film wrapper from certain packaged articles, they are not well suited for the removal of film is tightly wrapped around the package. Such tight wrapping is often associated with shrink wrap films. Thus the consumer often struggles to remove the wrapper and may find it necessary to use an additional instrument, such as a knife, a pair of scissors, or other sharp instrument, to remove all parts of the film wrapper. This is inconvenient not least because the consumer may not have a suitable additional instrument readily at hand. Furthermore, use of such instrument involves the risk of damaging the article.

SUMMARY OF THE DISCLOSURE

Accordingly, it is an object of the present invention to provide a packaged article with an improved carton label and film wrapper to facilitate easy opening and removal of the film wrapper by hand. Such means substantially eliminate the need for use of an additional instrument to remove the film wrapper.

It is another object of the invention to provide an easy to open and removable package wrapping that utilizes a perforated film, a carton label at least partially overwrapping the film and an adhesive overlying the perforated film and the carton label.

It is an additional object of the invention to provide a package wrapping that utilizes a film having a pair of spaced apart perforations defining a perforation zone there between, a carton label having a pair of spaced apart tabs defining a notch that extends across and makes visible a portion of the perforation zone when the label overlays the film, and an adhesive extending across a portion of the perforation zone and one of the spaced apart tabs wherein the carton label is not adhered to the film.

It is another object of the invention to provide a novel package wrapping and opening system comprising a carton, a film overwrapping at least a portion of the carton, a line of perforations disposed on the film, a label having a top and a bottom surface and a pair of spaced apart tabs defining a notch, the notch making visible at least a portion of the film and the line of perforations and an adhesive disposed on the top surface of the carton label end and the portion of film made visible by the notch.

It is a further object of the invention to provide a packaged article comprising a carton, a film at least partially overwrapping the carton, the film having a pair of spaced apart perforations defining a first width (W1), a carton label disposed over the film, the carton label having a first and a second end, the first end having a top and a bottom surface and a notch disposed therein, the notch having a second width (W2), generally measured along the front edge of the first end, that is from about 0.5 to about 1.5 times W1 and an adhesive disposed the top surface of the first carton label end and the portion of film within the notch.

It is an additional object of the invention to provide a package comprising a film at least partially overwrapping a carton, the film having a pair of spaced apart lines of perforations, a carton label at least partially overwrapping the film, the carton label having a first end with a top and a bottom surface and a notch disposed at the first end, the notch exposing the pair of spaced apart perforations, and a line of adhesive disposed substantially perpendicular to the lines of perforations, the adhesive contacting only the top surface of the first carton label end and the portion of film within the notch.

DEFINITIONS

As used herein, the term "adhered" refers to a first and a second substrate that are joined to one another by an adhesive disposed between the first and second substrates.

As used herein, the term "film" is inclusive of any plastic web regardless of whether it is film or sheet. The film can have a total thickness of 2.0 mils or less, such as a thickness from about 0.25 to about 2.0 mils and more preferably from about 0.4 to about 1.0 mils.

As used herein, the term "label" refers to a strip of plastic, paper, paperboard, cardboard, or the like that extends at least partially along one surface of a carton.

As used herein, the term "peelably adhered" refers to two substrates bonded together with sufficiently low adhesive strength that the substrates can be separated by being peeled apart without causing significant damage to either substrate, i.e., both substrates remain substantially intact after being peeled apart.

As used herein, the term "perforations" generally refers to any weakening of a material, such as the film, that facilitates the material being split into at least two parts. Perforations may include a line of weakness, apertures, slits, a thickness reduction in material or any other suitable weakening of the material that permits separation of the material into two or more parts.

As used herein, the term "perforation zone" refers to the area of film surrounding a peroration. Where perforations are provided as a single line of perforations the perforation zone generally lies on either side of the line of perforations from about 1 to about 30 mm, such as from about 5 to about 20 mm. Where perforations are provided as a pair of spaced apart lines of perforations the perforation zones is defined as the space between the lines of perforations. The perforation zone is generally defined herein as having a first width W1.

As used herein, the term "substantially free" generally refers to one or more surfaces of the label being substantially free from adhesive, such as the bottom surface of the first carton label end being substantially free from adhesive. In this regard substantially free means that the bottom surface does not contain a sufficient amount of adhesive to adhere it to the adjacent film. Generally any amount of adhesive found on the bottom surface of the first carton label end will be the result of seepage from application to an adjacent zone and will not be sufficient to adhere the label to the film.

DETAILED DESCRIPTION OF THE DISLOSURE

The present invention solves the problem of opening a package tightly wrapped in film without the use of an additional instrument, such as a knife, a pair of scissors, or other sharp instrument. In the instant invention the packaging materials themselves provide the means for removing the film. For example, by providing a carton label, perforations and an adhesive, the film overwrapping a package may be simply and efficiently removed.

Figure 1:
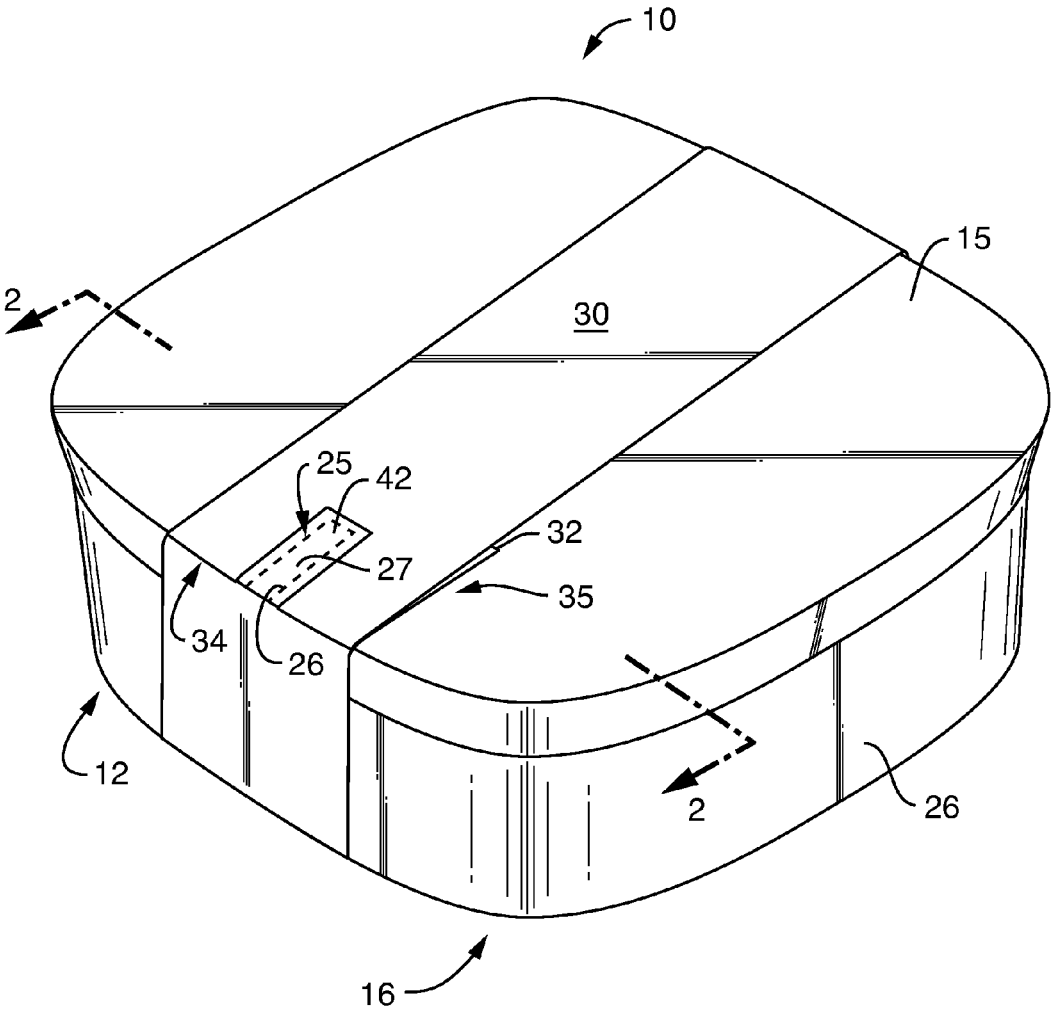
FIG. 1 is a perspective view of one embodiment of an easy open package according to the present invention.

Accordingly, in one embodiment the present invention provides an easy open package comprising a carton, such as a dispenser for storing and dispensing consumer goods, at least partially overwrapped with a film and provided with an easy open mechanism. With reference now to FIG. 1, in one embodiment the easy open package 10 comprises a carton 12, such as a four sided carton, having a top 15 and a bottom 16 surface. Although the dispenser is illustrated as being cubic, other shapes are contemplated and within the scope of the invention. As illustrated the easy open mechanism is disposed along the top surface 15, however, it may be disposed along any surface of the carton 12.

The carton 12 is at least partially covered with a film 20. The portion of the carton covered by film may range from about 10 percent of the surface area of the carton to about 100 percent, such as from about 50 to 100 percent. In one embodiment the film 20 may comprise a thermoplastic material that is shrinkable when heated. Suitable thermoplastic materials include, for example, polyester, polypropylene or polyethylene, or laminates thereof. In one embodiment, such as that illustrated in FIG. 1, the carton 12 has four sides, a top 15 and a bottom 16 and the entire carton 12 is overwrapped with a film 20.

The film 20 covered carton 12 is at least partially covered by a label 30, also referred to herein as a carton label. The label 30 is generally disposed over the film 20. While the label illustrated in FIG. 1 only partially overwraps the carton 12, the portion of the carton covered by the label is not so limited. In certain embodiments the entire carton may be overwrapped with a label. In other embodiments the label may only partially cover one side of the container. Further, the label may take many different shapes, including a band, as illustrated in FIG. 1. In other embodiments the label may be a sheet, a card or a tag that is disposed along only one surface, two surfaces, three surfaces or all the surfaces of the carton.

Generally the label is any strip of plastic, paper, paperboard, cardboard, or the like, that extends at least partially along one surface of a carton. In certain embodiments the band may cover at least a portion of all of the carton sides such that the band forms a "belly band" that fits closely around the midpoint, or "waist" of the carton. The belly band may be suitably fabricated from a strip of paper, paperboard, cardboard, or the like. The strip is scored and folded, and then the two ends of the strip are attached to each other to form a band. The band is shaped such that it may be slipped over one end of the carton and then slid into position around the "waist" of the carton. If desired, the band may be provided with printed matter, such as text or graphics.

With further reference to FIG. 1 the label 30 is in the form of a band having a first 32 and a second end 34, where the second end 34 overlaps the first end 32 to form a label overlap portion 35. The overlap portion 35 is illustrated as occurring along the top 15 surface of the carton 12 however; as one skilled in the art will appreciate the overlap may occur along any surface of the dispenser and may, in certain embodiments, extend along multiple surfaces. Depending on the dimensions of the dispenser 12 the length of the overlap 35 may range from about 0.5 to about 5.0 cm, such as from about 1 to about 3 cm and still more preferably from about 1.5 to about 2.0 cm.

The overlap portion 35 may be secured by disposing an adhesive 50 (illustrated in FIG. 2) between the first 32 and second 34 ends. In a particularly preferred embodiment the adhesive 50 is the same adhesive that provides the easy open mechanism and is disposed across a portion of the first end notch 36. The adhesive 50 peelably adheres the second end 34 to the first end 32 to form the overlap 35. The adhesive 50 is disposed such that when a user separates the first 32 and second 34 ends the adhesive 50 disposed on the film 20 is not significantly damaged.

In certain embodiments the overlap 35 may be provided with an overlap notch 42 which exposes a pair of spaced apart lines of perforations 25, 26 which define a perforation zone 27 therebetween. The formation, spacing and arrangement of the perforations 24 will be discussed in more detail below. The overlap notch 42 is formed by providing first and second ends 32, 34 with notches 36, 37 (illustrated in FIG. 2) such that when the ends 32, 34 are overlapped with one-another to form an overlapped portion 35, the notches 36, 37 align to form the overlap notch 42. While in FIG. 1 a portion of the second end 34 has been removed to form a second end notch 39 in certain embodiments the second end 34 may be provided with perforated tab which the user removes to create the notch 37. In still other embodiments the second end 34 may simply overlap the first end 32 and cover the first product label end notch 36. In this manner, the first product label end notch 36 only becomes visible once the second end 34 is detached from the first end 32 and the label 30 is partially removed from the package 10.

It will further be appreciated by one skilled in the art that the notch, whether the first or second end notch or the overlap notch may take on any number of shapes and sizes. The notch may simply be, as illustrated in FIGS. 1-5, a rectangular shaped notch formed by removing a portion of the label from one end thereby forming a pair of tabs that define the notch. In other embodiments the notch may be formed by cutting out a portion of the label such that the notch is surrounded by the label on the sides. In still other embodiments the notch may be rectangular, circular, semicircular, oval, or the like. Regardless of the shape and size of the notch or how it is formed, the notch is provided such that a portion of the film is not covered by a label. For example, as illustrated in FIG. 3, the notch 36 exposes the two lines of perforations 25, 26 when the label 30 is disposed over the film 20.

Figure 2:
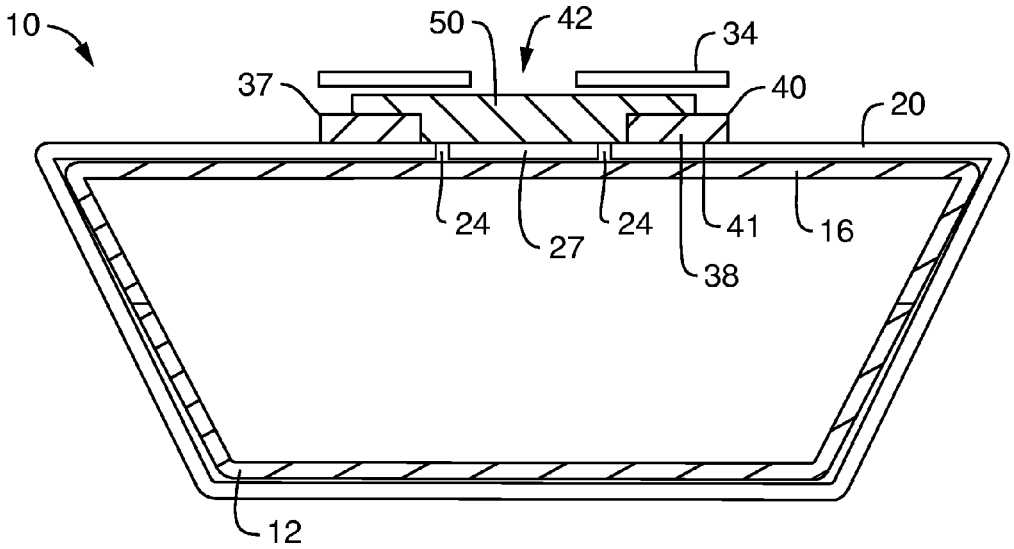
FIG. 2 is a vertical cross section through the package of FIG. 3 as would be seen when viewed along the lines 2-2 on FIG. 1.
Figure 3:
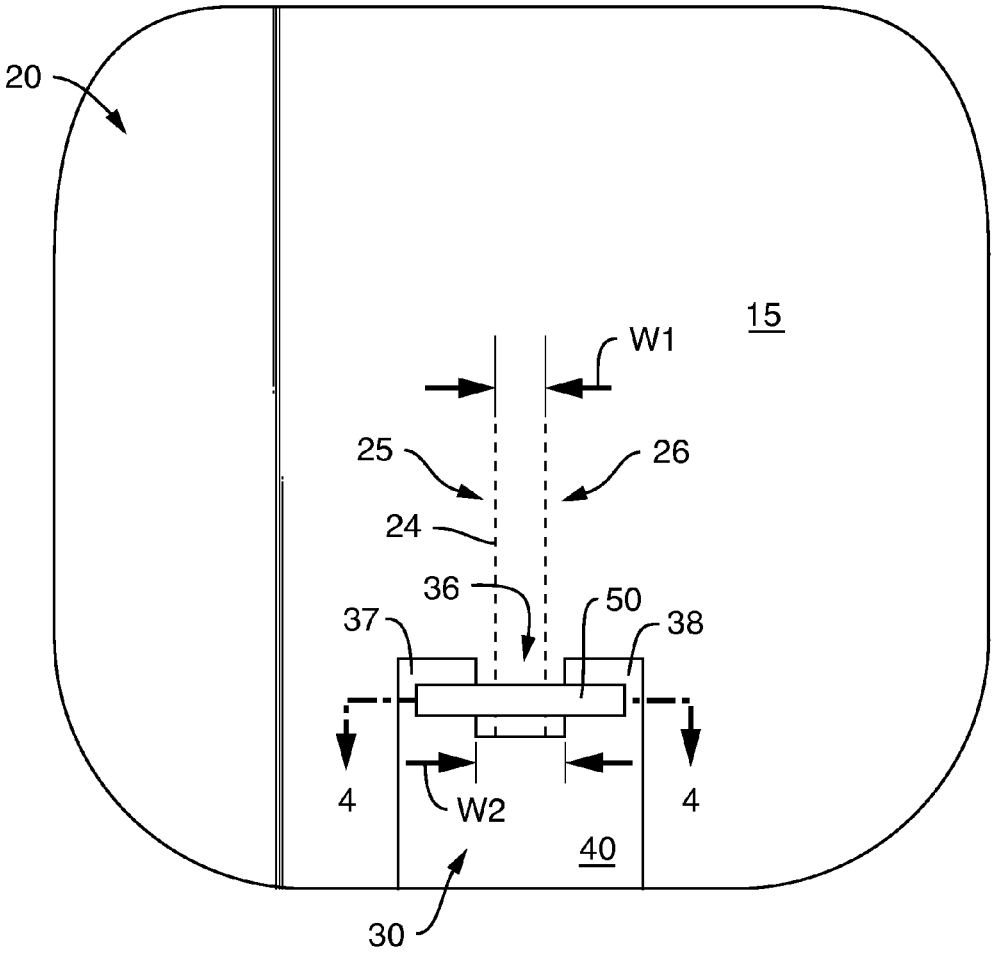
FIG. 3 is a top plan view of a package made according to one embodiment of the present invention.
Figure 4:
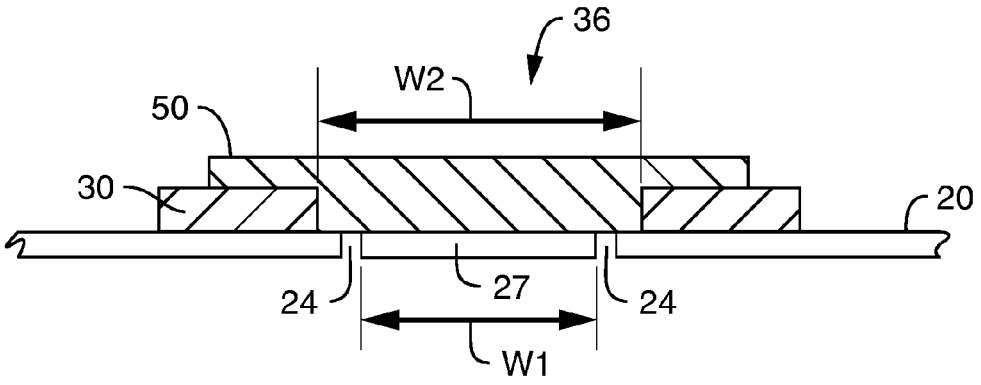
FIG. 4 is a vertical cross section through a portion of the package as would be seen when viewed along the lines 4-4 on FIG. 3.
Figure 5:
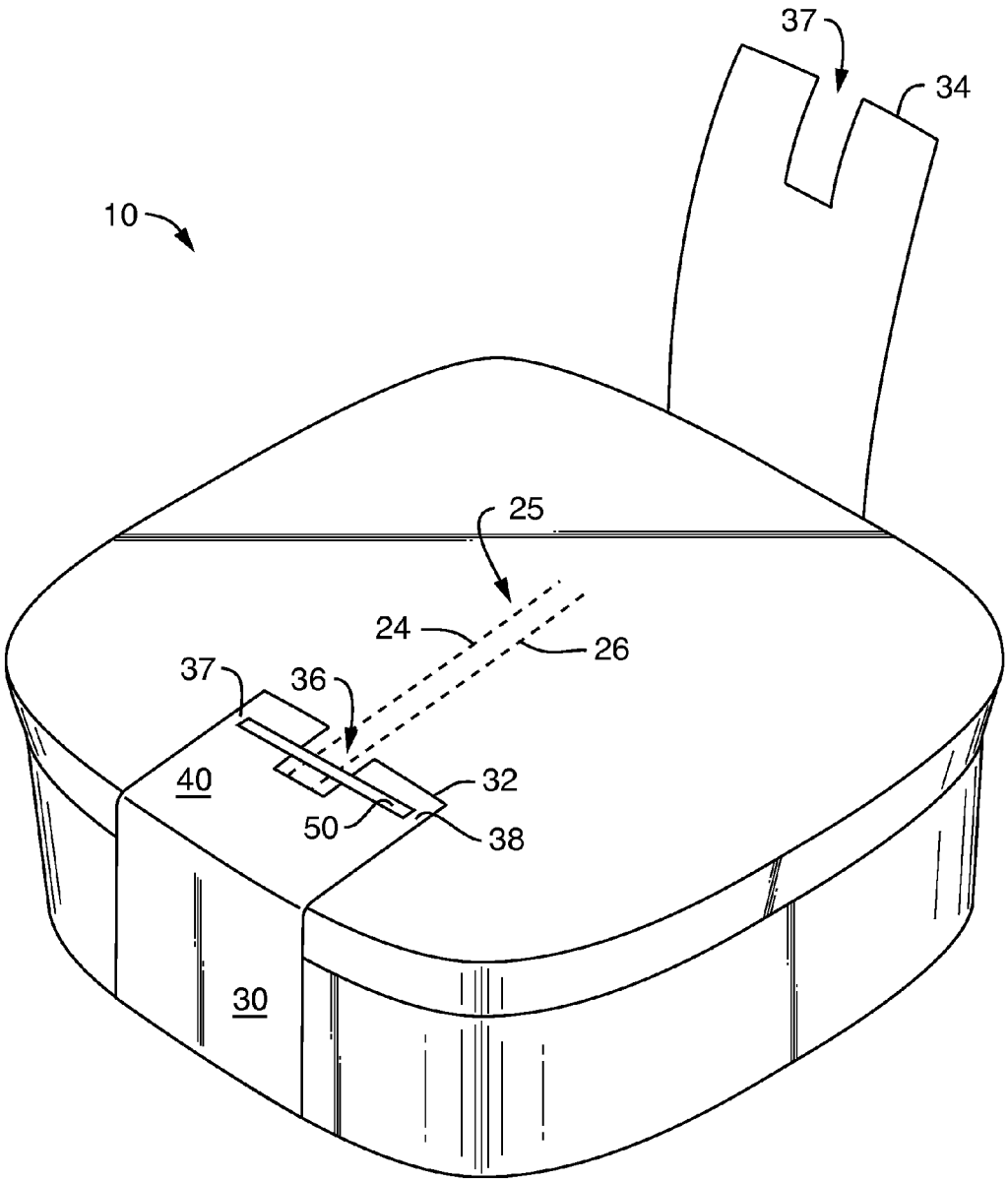
FIG. 5 is a perspective view of one embodiment of an easy open package according to the present invention.

Turning now to FIG. 2, a portion of the film 20 is provided with perforations 24. The perforations 24 may be a pair of spaced apart, parallel rows of perforations (as illustrated in FIGS. 3 and 5) or may be single row of perforations or several rows of perforations depending on the strength to the film and the desired shape and dimension of the resulting opening. To rupture the perforations 24 and open the film 20 an adhesive 50 is disposed across the perforations 24 and along at least one of the tabs 37, 38 forming the notch 36 in the first end 32. As illustrated the adhesive 50 is disposed on the upper surface 40 of the first end 32 as a strip of adhesive. One skilled in the art will appreciate however, that other adhesive patterns may be used.

As further illustrated in the embodiment of FIG. 2 the adhesive 50 spans the two tabs 37, 38, as well as the pair of perforations 24. Further, the adhesive 50 contacts the film 20 on either side of the perforations 24, as well as the perforation zone 27. The adhesive 50, however, does not adhere the first label end 32 to the film 20. Rather, the adhesive 50 is disposed on the top surface 40 of the first label end 32 such that the adhesive 50 extends between the tabs 37, 38 and contacts the film 20 along the perforation zone 27. In this manner the first label end 32 is attached to the film 20 via the adhesive 50 but is not adhered to the film 20. Because the first label end 32 is not adhered to film 20, in a particularly preferred embodiment, the bottom surface 41 of the first product label end 32 is substantially free of adhesive 50. As it is preferred not to adhere the first label end to the film one skilled in art will appreciate that the adhesive is applied after the label has been positioned over the film and perforation zone. As such no adhesive will purposefully be disposed along the bottom surface of the label and the first end of the label will not be adhered to the film.

To form the overlap portion 35 and connect the two ends of the label 30 to form a continuous band the adhesive 50 disposed on the top 40 of the first end 32 is contacted by the second end 34 of the carton label 30. In this embodiment two distinct zones are formed in the overlap portion 35. The first zone comprises first and second label ends 32, 34 with adhesive 50 disposed there-between. Because of the first and second end notches 37, 38, which, when the ends 32, 34 are overlapped to form the band, form overlap notch 42, the label 30 is not adhered to the film 20 by adhesive 50. The second zone comprises adhesive 50 bound to the film 20. The second zone is generally defined by the notch 36 and the adhesive 50 contacts the film 20 along at least a portion of the film 20 between the perforations 24 and portion of the film along the outer peripheral edge 27 of the perforations 24. In certain preferred embodiments the adhesive 50 is disposed along the entire portion of film 20 within the notch 36.

With continued reference to FIG. 2, to aid in removal of the film 20, a pair of spaced apart perforations 24 are provided. The perforations 24 are illustrated as being a pair of parallel, spaced apart apertures in the film 10, however, the configuration of the perforations is not so limited. Generally any arrangement of perforations which are compatible with the easy open system of the present invention and which allow the film to be separated into two or more parts are contemplated. In the illustrated embodiment the perforations 24 are arranged in two rows 25, 26 having a portion of film 27 disposed there-between. The perforation zone 27 has a first width W1.

The illustrated arrangement of two rows of perforations 25, 26 also define an outer peripheral portion 28 which lies adjacent to the tabs 36, 37 that form the first label end notch 36. In this manner the space between tabs 36, 37 defines a second width (W2). The second width is measured along the front edge of the first end and generally defines the width of the notch 36. As illustrated W2 is greater than W1 such that the outer peripheral edge portion 28 of the film 20 lies within the notch 36. In a particularly preferred embodiment, such as that illustrated in FIG. 2, the notch 36 extends beyond the two rows 25, 26 of perforations 24 a sufficient distance to insure exposure of two edges 28 of film 20.

While the illustrated embodiment shows W2 being greater than W1 the invention is not so limited. In other embodiments W1 may be greater than W2. As such the ratio of W1:W2 may range from about 0.5 to about 1.5, such as from about 0.75 to about 1.25. Regardless of widths of W1 and W2 the adhesive is disposed on the film within the perforation zone and on at least a portion of the upper surface of a tab defining the notch such that when the label is removed by a user an upward force on the label is transmitted to the film via the adhesive. The force exerted on the film causes the film to rupture about one or more perforations creating an opening in the film.

With further reference to FIG. 2 adhesive 50 is applied to at least a portion of the first end 32 and a portion of the perforation zone 27. In a particularly preferred embodiment the adhesive extends across both first end tabs 37, 38 and the portion of the perforation zone 27 lying there-between. In this manner, the adhesive 50 extends across at least a portion of the perforation zone 27, i.e., the area of film 20 lying between the lines of perforations 25, 26, but does not adhere to the first end 32 of the label to the film 20. The adhesive 50 however, is disposed on the perforation zone 27 and the label 30 such that the label 30 is attached to the film 20 and is capable of transmitting a force to the film 20 when the label is removed by the user.

In other embodiments the package is provided with an easy open mechanism comprising a label having first and second ends, wherein the ends do not overlap with one another. The first end of the label is provided with a notch defined by a pair of spaced apart tabs. The notch has a width W2, as measured along the front edge of the first end. The notch may be any shape, such as square, rectangular, semicircular, etc., so long as it provides a pair of spaced apart tabs. The film is provided with a pair of spaced apart perforations defining a perforation zone. The label is positioned such that the notch overlays at least a portion of the perforation zone. The label is attached to the film by applying an adhesive across the notch, however, it is preferred that the label is not directly adhered to the film. That is, it is preferred that the bottom surface of the label is substantially free of adhesive. To open the package the user grips the second end of the label, which is not adhered to the film, and lifts upward. The user then proceeds to pull the second label end towards and then past the first end. As the second end is pulled past the first end an upward force is applied to the adhesive. The upward force on the adhesive is transmitted to the film adhered thereto and causes the perforations to rupture. The ruptured perforations in-turn form an opening for easy removal of the film.

Because the adhesive is generally applied as a means of transmitting a force between the label and the film a wide range of adhesives may be suitable. In one embodiment, to enable easy opening of the packaging it is preferred that the adhesive be weak enough to allow the overlapped label to be separated without rupturing the unbroken film, but strong enough to hold to the wrapper film below the perforation line, rupturing the film through the perforations, and allowing teardown of the wrapper film. Suitable adhesives include, for example, hot melt adhesives. A hot melt adhesive typically melts upon heating and flows substantially freely for application to the product label and film. Upon cooling the adhesive hardens forming bond with the top surface of the product label and film. Hot melt adhesives are well known in the art and may include adhesives such as those disclosed in U.S. Pat. Nos. 5,026,752 and 4,283,317, both of which are incorporated herein in a manner consistent with the present disclosure.

As further illustrated in FIG. 3, the length of perforations 24 may be varied depending on the desired opening size and do not necessarily extend the full length of the bottom 16 of the carton 10. Rather, in the illustrated embodiment, the perforations extend only partially along the bottom, such as from about 10 to about 90 percent of the length of the bottom, such as from about 20 to about 60 percent and more preferably from about 30 to about 50 percent. In other embodiments the perforations may extend across the entire length of the bottom and in other embodiments may even extend along one or more sides of the package. In one preferred embodiment the perforations are provided as a pair of parallel, spaced apart apertures, the length of the perforations ranging in length from about 2 to about 10 cm, and more preferably from abut 3 to about 8 cm, and being spaced apart from about 0.5 to about 4.0 cm and preferably from about 1.0 to about 3.0 cm.

To open the package a user grasps the second end of the label and proceeds to remove the label by lifting the second end towards the first end. As the user removes the label it will generally only be attached to the film by the adhesive extending across the notch at the first end. To finish opening the second end is pulled beyond the first end causing an upward force to be exerted on the adhesive and the film adhered thereto. The upward force will cause the film to be ruptured along the perforations creating an opening. The user may continue removing the label and then remove the film using the opening created by removal of the label. In this manner the completely sealed package may be provided but does not require the use of any tool to open it, the label and adhesive providing the package opening function.

What is claimed is:

1. An easy open package comprising a carton, a film at least partially overwrapping the carton, perforations disposed on the film and defining a perforation zone, and a label comprising a first end and a second end, the first end having a top surface, a bottom surface and a notch defined by a pair of spaced apart tabs, the label disposed on the film such that the first end notch exposes at least a portion of the perforation zone and an adhesive disposed on both the top surface of at least one of the tabs and the perforation zone exposed by the notch.

2. The easy open package of claim 1 wherein the perforations are a line of perforations and the adhesive is a continuous line of adhesive that is substantially perpendicular to the line of perforations.

3. The easy open package of claim 2 wherein the adhesive is disposed on the top surface of both spaced apart tabs defining the notch.

4. The easy open package of claim 1 wherein the bottom surface of both spaced apart tabs is substantially free from adhesive.

5. The easy open package of claim 1 wherein the carton has a pair of opposed sidewalls, a top and a bottom all overwrapped by the film and wherein the first and second label ends overlap one-another to form a band with a label overlap portion.

6. The easy open package of claim 5 wherein the second label end is peelably adhered to the first label end by the adhesive.

7. The easy open package of claim 1 wherein the first label end is not adhered to the film.

8. The easy open package of claim 1 wherein the perforation zone has a width W1 and the notch has a width W2 and W1 is greater than W2.

9. The easy open package of claim 1 wherein the perforation zone has a width W1 and the notch has a width W2 and W2 is greater than W1.

10. The easy open package of claim 1 wherein the perforations are a pair of spaced apart parallel lines of perforations defining a perforation zone having a width W1 and the notch has a width W2 and wherein W2 is greater than W1.

11. An easy open package comprising a carton wrapped in a film having two spaced apart lines of perforations defining a perforation zone having a width W1, a product label having a first and a second end, the first product label end having a top surface, a bottom surface, a first tab and a second tab, the first and the second tabs defining a notch having a width W2, the product label extending around the carton and contacting the film and positioned such that the notch exposes a portion of the perforation zone, and a continuous line of adhesive disposed on the top surface of at least one tab and a portion of the perforation zone.

12. The easy open package of claim 11 wherein two lines of perforations comprise two substantially straight rows of perforations.

13. The easy open package of claim 12 wherein the perforations are uniformly spaced apart apertures having a length from about 0.5 to about 4.0 cm and wherein W1 is from about 0.5 to about 4.0 cm and W2 is from about 1.0 to about 5.0 cm.

14. The easy open package of claim 11 wherein two lines of perforations comprise two substantially straight rows of perforations and the adhesive is disposed as a straight line of adhesive substantially perpendicular to the lines of perforations.

15. The easy open package of claim 11 wherein the adhesive is disposed on at least a portion of both of the tabs defining the notch.

16. The easy open package of claim 11 wherein the bottom surface of the first end is substantially free from adhesive.

17. The easy open package of claim 11 wherein the first and second label ends overlap one-another to form a band with a label overlap portion and wherein the second label end is peelably adhered to the first label end by the adhesive.

18. An easy open package comprising a carton at least partially wrapped in a film, having two lines of perforations spaced apart from one another and defining a perforation zone having a width W1, a label having a first and a second end that overlap one another to form a label band that surrounds the carton, the first end having a top, a bottom and a pair of spaced apart tabs defining a notch having a width W2, the label positioned such that the notch exposes a portion of the perforation zone and a continuous strip of adhesive disposed across the notch.

19. The easy open package of claim 18 wherein W1 is greater than W2.

20. The easy open package of claim 18 wherein W2 is greater than W1.

* * * * *